US009103076B2

(12) United States Patent
Hassan

(10) Patent No.: US 9,103,076 B2
(45) Date of Patent: Aug. 11, 2015

(54) UNITARY SAFETY SURFACE TILES AND ASSOCIATED STRUCTURES

(71) Applicant: Morris Hassan, Lakewood, NJ (US)

(72) Inventor: Morris Hassan, Lakewood, NJ (US)

(73) Assignee: Playsafer Surfacing LLC a division of Rubberecycle, Lakewood, NJ (US)

( * ) Notice: Subject to any disclaimer, the term of this patent is extended or adjusted under 35 U.S.C. 154(b) by 0 days.

(21) Appl. No.: 14/135,492

(22) Filed: Dec. 19, 2013

(65) Prior Publication Data

US 2014/0186112 A1 Jul. 3, 2014

Related U.S. Application Data

(60) Provisional application No. 61/747,887, filed on Dec. 31, 2012.

(51) Int. Cl.

| | |
|---|---|
| ***E01C 13/00*** | (2006.01) |
| ***E01C 13/06*** | (2006.01) |
| ***E01C 15/00*** | (2006.01) |
| ***E01C 3/00*** | (2006.01) |
| ***E01C 13/04*** | (2006.01) |

(52) U.S. Cl.

CPC ..... *E01C 13/00* (2013.01); *E01C 3/006* (2013.01); *E01C 13/045* (2013.01); *E01C 13/06* (2013.01); *E01C 15/00* (2013.01)

(58) Field of Classification Search

CPC ..... E01C 3/06; E01C 13/00; E01C 15/00; E01C 3/006; E01C 13/045; E01C 13/06

USPC ..... 404/28, 31, 34, 35, 41, 82, 73

See application file for complete search history.

(56) References Cited

U.S. PATENT DOCUMENTS

| | | | | |
|---|---|---|---|---|
| 3,025,935 | A | 3/1962 | Ensrud et al. | |
| 3,507,634 | A | 4/1970 | O'Driscoll | |
| 4,287,693 | A * | 9/1981 | Collette | 52/177 |
| 4,292,375 | A | 9/1981 | Ko | |
| 4,965,138 | A | 10/1990 | Gonzalez | |

(Continued)

FOREIGN PATENT DOCUMENTS

| | | |
|---|---|---|
| DE | 2946242 | 5/1981 |
| WO | WO 03000994 | 1/2003 |

OTHER PUBLICATIONS

International Search Report for International Application No. PCT/US13/78203, May 7, 2014.

(Continued)

*Primary Examiner* — Raymond W Addie

(74) *Attorney, Agent, or Firm* — Weiss & Arons LLP

(57) ABSTRACT

A unitary safety surface tile. The tile may interlock with at least one other tile. Each tile may be configured for disposing on a base of loose fill. Each tile may be configured for receiving a covering of loose fill. Each tile may include a plurality of hollow pockets. Each of the pockets may connect to at least one other pocket along a top edge of each pocket. Each of the pockets may engage the base of loose fill and/or receive the covering of loose fill. Each of the pockets may include one or more apertures for allowing passage of fluid through each of the pockets. Each tile may further include a plurality of edges. The edges may border the plurality of pockets. Each of one or more of the edges may be adapted for engaging at least one edge of at least one other unitary safety surface tile.

23 Claims, 11 Drawing Sheets

(56) References Cited

U.S. PATENT DOCUMENTS

| | | | | |
|---|---|---|---|---|
| 5,026,207 | A | 6/1991 | Heath | |
| 5,044,821 | A * | 9/1991 | Johnsen | 405/50 |
| 5,234,738 | A | 8/1993 | Wolf | |
| 5,292,130 | A * | 3/1994 | Hooper | 473/279 |
| 5,383,314 | A * | 1/1995 | Rothberg | 52/169.5 |
| 5,460,867 | A * | 10/1995 | Magnuson et al. | 428/178 |
| 5,489,462 | A * | 2/1996 | Sieber | 428/174 |
| 5,509,244 | A | 4/1996 | Bentzon | |
| 5,527,128 | A | 6/1996 | Rope et al. | |
| 5,714,263 | A | 2/1998 | Jakubisin et al. | |
| 5,894,045 | A | 4/1999 | Desrondiers | |
| 5,930,970 | A | 8/1999 | De Le fevre | |
| 6,065,266 | A | 5/2000 | Behr et al. | |
| 6,131,005 | A | 10/2000 | Ozawa | |
| 6,221,445 | B1 | 4/2001 | Jones | |
| 6,616,542 | B1 * | 9/2003 | Reddick | 473/171 |
| 6,777,062 | B2 | 8/2004 | Skaja | |
| 7,033,666 | B2 | 4/2006 | Skaja | |
| 7,950,191 | B2 | 5/2011 | Brouwers | |
| 8,122,656 | B1 | 2/2012 | Poulsen | |
| 8,353,640 | B2 * | 1/2013 | Sawyer | 404/4 |
| 8,668,403 | B2 * | 3/2014 | Sawyer | 404/28 |
| 8,807,865 | B1 * | 8/2014 | Modrono | 404/34 |
| 2007/0087154 | A1 | 4/2007 | Bird et al. | |
| 2010/0293877 | A1 | 11/2010 | Harris et al. | |
| 2011/0005165 | A1 | 1/2011 | Stadthagen-Gonzalez | |

OTHER PUBLICATIONS

"ADA Beach Access Mats," General Recreation, Inc., 2013.
"Deschamps—Innovative solutions for enhanced access to outdoor recreational areas," Deschamps, Angouleme, France.
"Playground Injuries: Fact Sheet," Centers for Disease Control and Prevention (CDC), Mar. 29, 2012, Atlanta, Georgia.
"Public Playground Safety Handbook," U.S. Consumer Product Safety Commission, Nov. 2010, Bethesda, Maryland.
"Playground Safety," National Safety Council, Feb. 2011.
"2010 ADA Standards for Accessible Design," Department of Justice, Dec. 7, 2012.

* cited by examiner

UNITARY SAFETY SURFACE TILES AND ASSOCIATED STRUCTURES

CROSS-REFERENCE TO RELATED APPLICATION

This application is a non-provisional application of U.S. Provisional Application No. 61/747,887, filed Dec. 31, 2012, which is hereby incorporated by reference herein in its entirety.

FIELD OF TECHNOLOGY

Aspects of the disclosure relate to surface tiles. More particularly, the disclosure relates to surface tiles, and associated structures, for use in playgrounds, beaches and/or in other suitable areas such as outdoor scenic trails and indoor recreational spaces.

BACKGROUND OF THE INVENTION

According to 2012 Centers for Disease Control and Prevention statistics, each year, in the United States alone, over 200,000 playground injuries result in children's emergency room visits, with over three-quarters of those injuries being from falls. Approximately half of all playground injuries may be severe, involving fractures, internal injuries, concussions, dislocations and/or amputations.

To protect children from fall injuries, playgrounds have been required to provide safety surfaces. A safety surface may be required to underlie and/or cover a playground area on which children may fall. The area may typically be associated with playground equipment, such as swings, horizontal ladders and climbing equipment, from which a fall can be from an elevation several times a child's height. The safety surface may attenuate impact forces associated with the fall. Safety surfaces may be also be mandated by requirement, or recommended as "best practice," for other playground areas and recreational areas as well, such as in zones along paths and adjacent to "whirls"/"roundabouts."

The safest current playground safety surface material may be a loose fill material such as shredded rubber, crumb rubber, wood fiber, pea gravel or sand. Such loose fill material may not only provide a highly safe surfacing option; it may also be highly cost effective, being an option in which materials and labor of installation may be of relatively low cost. In addition, such materials as shredded rubber and crumb rubber may be environmentally friendly "green" materials, made from repurposed used automobile tires.

A drawback of such loose fill material may be that such loose fill material may typically allow relatively poor wheelchair accessibility. Wheelchair accessibility may be compromised because such loose material may provide poor wheel traction. Wheelchair accessibility may be compromised because wheelchair wheels may sink into such loose fill material and may become mired in the material.

The American Disabilities Act (ADA) requires that all public playgrounds and beaches be accessible to disabled people. Public playgrounds may include recreational areas at community parks, commercial childcare facilities, schools and condominium buildings. ADA standards may be extended to apply to other areas, such as nature trails.

ADA standards require a unitary safety surface such as one made from poured-in-place rubber or from thick interlocked rubber tiles. These surfaces are relatively hard and may not provide sufficient attenuation of impact forces to adequately protect children from falls. While these surfaces may rate high on accessibility, they may rate low on safety. In addition, while these surfaces may rate high on accessibility, they may rate low on cost effectiveness. Current unitary surfaces may be costly; in certain instances, the cost of a current unitary surface may exceed the cost of a playground's play equipment.

New ADA standards may proscribe the use of loose fill materials as currently practiced on playgrounds because of loose fill materials' typically low accessibility ratings. However, implementation of such ADA standards with current unitary surfacing technologies may result in more playground injuries, particularly severe injuries, with the outcome that ADA compliant playgrounds may sacrifice safety for accessibility.

In addition, elimination of the current use of loose fill materials and the installation, in their place, of current costly unitary surfaces may pose economic hardship on playground owners. The economic hardship may be particularly acute in cases where a playground may be an interim recreational area, such as during a facility's renovation or prior to a facility's move to a different site.

It would be desirable, therefore, to provide apparatus and methods for making playgrounds and related areas wheelchair accessible without sacrificing safety. It would also be desirable to provide apparatus and methods for making playgrounds and related areas accessible without sacrificing cost effectiveness. It would be desirable that cost effectiveness be maintained in materials and/or labor for retrofitting, installation and/or repair of accessible and safe areas.

SUMMARY OF THE DISCLOSURE

It is an object of this invention to provide apparatus and methods for making playgrounds and related areas wheelchair accessible without sacrificing safety. It is also an object of this invention to provide apparatus and methods for making safe, accessible playgrounds and related areas cost effective to install and repair.

Such cost effective installation may involve producing a new safe and accessible playground or recreational area. Such cost effective installation may involve retrofitting an existing playground or recreational area, converting it into a safe, accessible area. Such cost effective installation may also allow for interim playgrounds or interim recreational areas to feature both accessibility and safety.

The apparatus of this invention may feature, and the methods of the invention may involve, one or more relatively thin walled modular tiles. The modular tiles may be readily associated on site to form cost effective unitary surfaces. The modular tiles may be laid over loose fill material. The modular tiles may stabilize the underlying loose fill material. The modular tiles may be topped with loose fill material. The modular tiles may stabilize the overlying loose fill material. The unitary surfaces so produced, in conjunction with the loose fill material, may provide wheelchair accessibility, while enhancing safety characteristics of loose fill material.

BRIEF DESCRIPTION OF THE DRAWINGS

The objects and advantages of the invention will be apparent upon consideration of the following detailed description, taken in conjunction with the accompanying line drawings, in which like reference characters refer to like parts throughout, and in which.

DETAILED DESCRIPTION OF THE DISCLOSURE

Figure 1:
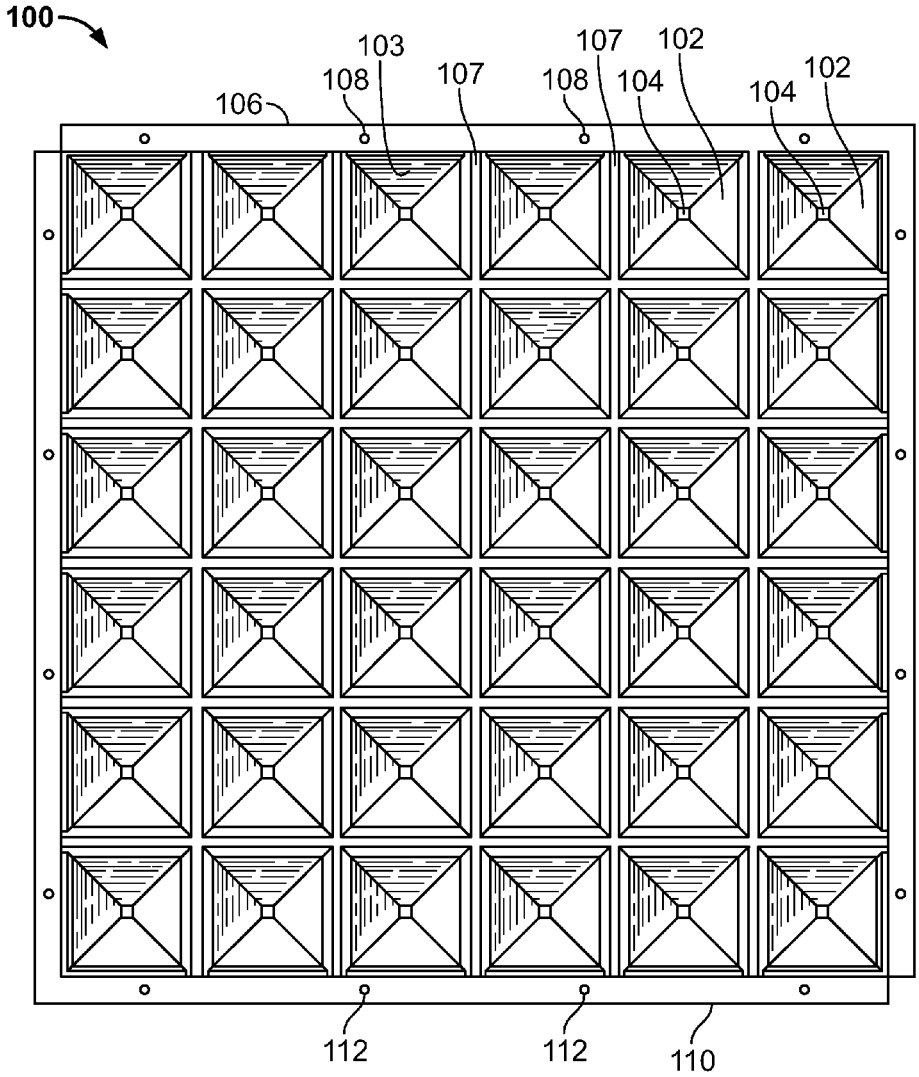
FIG. 1 is a top plan view of apparatus in accordance with principles of the invention.

Apparatus and methods for making playgrounds and related areas wheelchair accessible without sacrificing safety are provided. The apparatus may include, and the methods may involve, components and processes that make safe, accessible playgrounds and related areas cost effective to install and repair. Such cost effective installation may involve producing a new safe and accessible playground or recreational area. Such cost effective installation may involve retrofitting an existing playground or recreational area, converting it into a safe, accessible area.

The apparatus may include, and the methods may involve, mat/tiles (hereinafter, in the singular, a "mat/tile"). A mat/tile may be made from plastic, rubber or both. The rubber may be recycled rubber. The mat/tile may be made either exclusively from, or in combination with, any other suitable substance(s) added to or independent of the plastic and/or the rubber. Other suitable substance(s) may include readily biodegradable fibrous biomass, such as untreated wood fiber, and non-readily biodegradable fibers, such as nylon fiber.

Using recycled rubber, such as repurposed tire rubber, to produce the mat/tiles may be preferable because of easy access to supply as well as reduced production costs and high durability of the mat/tiles so produced. Using biodegradable biomass, such as repurposed saw mill waste and beer hops waste, to produce the mat/tiles may be preferable in situations where a playground may be intended to be abandoned after a relatively short period of use.

The mat/tile may include a thickness of the constituent substance(s). The mat/tile may include several thicknesses of substance(s), each thickness characterizing a different structural feature of the mat/tile. The thickness(es) may be between ⅛" to 1" or any other suitable thickness(es). Other suitable thickness (es) may be equal to or less than ⅛". Other suitable thickness(es) may be equal to or more than 1".

The mat/tile may be disposed on a base layer of loose fill material (hereinafter, in the alternative, "loose fill"). The loose fill may include crumb rubber, wood mulch, or both. The loose fill may include exclusively, or in combination, any other suitable substance(s) added to or independent of the crumb rubber and/or the wood mulch. Other suitable substance(s) may include shredded rubber, wood fiber, pea gravel and sand.

The mat/tile may be overlain with a cover layer of loose fill. The loose fill of the cover layer may be the same as the loose fill of the base layer. The loose fill of the cover layer may be different, in whole or in part, from the loose fill of the base layer.

The mat/tile may include a plurality of empty pockets. A pocket may include an interior surface. The interior surface may be concave. Concavity of the interior surface may be defined relative to a top surface of the mat/tile, as viewed from above the mat/tile. The pocket may include a concave depression in the mat/tile.

The interior surface may receive part of the loose fill of the cover layer. The loose fill of the cover layer may be received from above the mat/tile. The concavity may be of any shape suitable for receiving loose fill from above. Receiving part of the loose fill of the cover layer by the pocket may stabilize the loose fill of the cover layer. Stabilizing the loose fill of the cover layer may contribute to keeping the loose fill in place.

The pocket may include at least one pocket upper edge. The pocket upper edge may be part of a pocket rim. The pocket may be proximal to at least one other pocket. The pocket may be proximal to the at least one other pocket along the pocket upper edge. The pocket may be proximal to the at least one other pocket along at least part of the pocket rim.

The pocket upper edge may be part of a pocket upper perimeter. The pocket upper perimeter may be a perimeter of the pocket rim. The pocket upper perimeter may be an upper perimeter of the concave depression.

The pocket upper perimeter may include a perimeter shape. The perimeter shape may be polygonal, such as triangular, quadrilateral or any other suitable polygonal shape. Other suitable polygonal shapes may include pentagonal shapes and hexagonal shapes. Other suitable polygonal shapes may include star polygons.

The perimeter shape may be a curvilinear polygon, such as a trefoil, a quatrefoil or any other suitable curvilinear polygon shape. Other suitable curvilinear polygon shapes may include a cinquefoil. Other suitable curvilinear polygon shapes may include a hexafoil.

The perimeter shape may be a compound polygon, such as a triangle with two straights sides and a curved base curving into an area between the two straight sides, a triangle with two straights sides and a curved base curving away from the area between the two straight sides, or any other suitable compound polygon shape. Other suitable compound polygon shapes may include a shape with three sides of a trapezoid and a crescent-shaped fourth side.

The perimeter shape may be an ellipse, such as a circle, a golden ellipse or any other suitable ellipse. Other suitable ellipses may include a Steiner ellipse of a given triangle.

The perimeter shape may be any other suitable shape. Other suitable shapes may include an oval. Other suitable shapes may include a crescent.

The pocket may include an exterior surface. The exterior surface may be convex. The exterior surface may engage part of the loose fill of the base layer. Engaging part of the loose fill of the base layer by the exterior surface of the pocket may stabilize the loose fill of the base layer. Stabilizing the loose fill of the base layer may contribute to keeping the loose fill in place.

The exterior surface may have surface features. The surface features may include the surface being smooth. The surface features may include the surface being rough. The surface features may include the surface being bumpy. The surface features may include the surface being stepped. The surface features may include the surface being ridged.

The exterior surface may be part of a geometric face. The geometric face may be continuous. The geometric face may be discontinuous. The geometric face may be interrupted. The geometric face may be interrupted by surface features of the exterior surface.

The geometric face may be part of an outer pocket shape. The exterior surface may be part of an outer pocket shape. The outer pocket shape may be part of a polyhedral shape, such as a pyramidal shape, a tetrahedral shape or any other suitable polyhedral shape. Other suitable polyhedral shapes may include a prism, such as a cuboid.

The outer pocket shape may be part of a curvilinear polyhedron, such as a curve-faced pyramid, a curve-faced tetrahedron or any other suitable curvilinear polyhedron shape. Other suitable polyhedral shapes may include a curve-faced prism, such as a curve-faced cuboid. One, or more than one, geometric face of the curvilinear polyhedron may be curved. Curvature of the curved face(s) may be concave. Curvature of the curved face(s) may be convex.

The outer pocket shape may be part of a compound polyhedron, such as a square pyramid of a base-side of length s joined at its base to a cube of edge-side of length s, or any other suitable compound polyhedron shape. Other suitable compound polyhedron shapes may include a tetrahedron joined at a base to a triangular prism.

The outer pocket shape may be part of an ellipsoid, such as a sphere, a prolate ellipsoid, or any other suitable ellipsoid. Other suitable ellipsoids may include an oblate ellipsoid.

The outer pocket shape may be part of any other suitable shape. Other suitable shapes may include a cone. Other suitable shapes may include a frusto-conical shape. Other suitable shapes may include a cylinder. Other suitable shapes may include a cylinder capped by a cone. Other suitable shapes may include a cylinder capped by a hemisphere. Such suitable shapes may include any shape that is sufficient to engage the base layer.

The pocket outer shape may include an extremity. The extremity may be at a maximal depth distance from the pocket upper edge. The extremity may be at a deepest region of engagement of the pocket with the base layer. Loose fill of the base layer may surround the extremity. The extremity may contact a ground surface beneath the mat/tile. The ground surface may underlie an outdoor play area. The extremity may contact a flooring surface beneath the mat/tile. The flooring surface may underlie an indoor play area. (The term "ground/flooring surface" may encompass both or either the ground surface and/or the flooring surface.)

In either an outdoor play area or and an indoor play area, there may be a depth of loose fill beneath the extremity. Loose fill of the base layer may underlie the extremity. There may be loose fill between the ground/flooring surface and the extremity.

A perimeter of the pocket outer shape proximal to the extremity may be a pocket lower perimeter. A pocket lower perimeter parallel to the pocket upper perimeter may be smaller than the pocket upper perimeter.

If an exemplary pocket has a pocket upper perimeter that is a circle of radius r and a pocket outer shape that is a right circular cone of a radius approximating r (approximately r plus a thickness of the substance(s) of the pocket) and with a base parallel to, and continuous with, the substance(s) of the pocket upper perimeter, the exemplary pocket may appear, as viewed from above the mat/tile, as an empty conical concavity with a circular rim; the extremity of the exemplary pocket may be an apex of the cone. A perimeter of the right circular cone, taken perpendicular to an altitude of the cone, proximal to the apex may be smaller than the pocket upper perimeter.

The pocket may include one, or more than one, other extremity. Extremities of a mat/tile may have the same maximal depth. Extremities of a mat/tile may have different maximal depths. The plurality of pockets may include pockets of the same outer pocket shape. The plurality of pockets may include pockets of different outer pocket shapes.

The pocket may include an aperture. The aperture may interrupt at least part of the interior surface. The aperture may interrupt at least part of the exterior surface. The aperture may interrupt at least part of the geometric face. The aperture may interrupt at least part of the outer pocket shape. The aperture may lie proximal to the extremity.

The aperture may lie between the interior surface and the exterior surface. The aperture may extend between the interior surface and the exterior surface. The aperture may be a hole running through the substance(s) of the pocket. The hole may run straight. The hole may be circuitous.

The aperture may be microscopic. The aperture may be macroscopic. The aperture may be of any suitable size.

The aperture may be of any suitable shape. A suitable aperture shape may be round. A suitable aperture shape may be square.

The aperture may allow passage of fluid through the pocket. The aperture may allow passage of fluid between the interior surface and the exterior surface. The aperture may allow passage of fluid from the interior surface to the base layer. The aperture may allow passage of fluid from the interior surface to the ground/flooring surface. Passage of fluid may allow drainage of fluid from the top surface of the mat/tile to the base layer and/or the ground/flooring surface.

The pocket may include one, or more than one, aperture. The pocket may include multiple apertures of the same shape. The pocket may include multiple apertures of different shapes. The pocket may include multiple apertures of the same size. The pocket may include multiple apertures of different sizes. Aperture number, aperture shape and/or aperture size may be referred to collectively as aperture configuration.

The mat/tile may include another, or more than one other, pocket of the same aperture configuration. The mat/tile may include one, or more than one, pocket of a different aperture configuration. The mat/tile may include pockets of several different aperture configurations. The plurality of pockets may include pockets of the same aperture configuration. The plurality of pockets may include pockets of different aperture configurations.

In the exemplary pocket, above, of right circular conical outer pocket shape, the aperture may be a hole through the wall of the cone. The aperture may be proximal to the apex. The aperture may run through the apex. The aperture may truncate the apex. If the apex is truncated, the empty circular-rimmed right conical concavity of the exemplary pocket may be more accurately described as an empty circular-rimmed right frusto-conical concavity.

The mat/tile may include another, or more than one other, pocket of the same perimeter shape of the upper perimeter. The mat/tile may include one, or more than one, pocket of a different perimeter shape. The mat/tile may include pockets of several different perimeter shapes. The plurality of pockets may include pockets of the same pocket perimeter shape. The plurality of pockets may include pockets of different pocket perimeter shapes.

The mat/tile may include another, or more than one other, pocket of the same outer pocket shape. The mat/tile may include one, or more than one, pocket of a different outer pocket shape. The mat/tile may include pockets of several different outer pocket shapes. The plurality of pockets may include pockets of the same outer pocket shape. The plurality of pockets may include pockets of different outer pocket shapes.

The mat/tile may include a plurality of tile edges. The plurality of tile edges may be peripheral to an area of the mat/tile. The plurality of tile edges may surround the area of the mat/tile. The plurality of tile edges may define the area of the mat/tile. The area of the mat/tile within the plurality of tile edges may include the plurality of pockets. The area of the mat/tile within the plurality of tile edges may include most of a "footprint" of the mat/tile on the base layer.

The area of the mat/tile within the plurality of tile edges may include an area shape. The area shape may be any suitable shape, such as a polygon, a curvilinear polygon, a compound polygon, an ellipse and any other suitable shape. Other suitable shapes may include an oval. Other suitable shapes may include a crescent.

The plurality of tile edges may border the area shape. A tile edge may border at least part of the area shape. The tile edge may border at least part of the plurality of pockets. The tile edge may border at least part of a plurality of concave depressions of the mat/tile. The tile edge may border at least part of a plurality of rims of pockets. The tile edge may be integral to at least part of the plurality of rims of pockets. The tile edge may include the substance(s) of the rims. The tile edge may include one or more substances different from the substance(s) of the rims.

A unitary safety surface of mat/tile(s) may include the mat/tile. The unitary safety surface of mat/tile(s) may include no other mat/tile. The unitary safety surface of mat/tile(s) may include another, or more than one other, mat/tile. The unitary safety surface of mat/tile(s) may be disposed on at least part of the ground/flooring surface. The unitary safety surface of mat/tile(s) may be disposed on at least part of the base layer. The unitary safety surface of mat/tile(s) may be overlain by at least part of the cover layer. The unitary safety surface of mat/tile(s) may be overlain by at least part of an overlay layer of loose fill. The overlay layer may lie over the cover layer. The unitary safety surface of mat/tile(s) may be wheelchair accessible. The mat/tile, the other mat/tile and the more than one other mat/tiles may be structural elements of the unitary safety surface of mat/tile(s).

A support rib may support the mat/tile. The support rib may be engaged with the mat/tile. The support rib may be engaged with an additional, or more than one additional, mat/tile. The unitary safety surface of mat/tile(s) may include one, or more than one, support rib. The one support rib and the more than one support rib may be structural elements of the unitary safety surface of mat/tile(s).

A border rail may border the mat/tile. The border rail may be engaged with the mat/tile. The border rail may be engaged with an additional, or more than one additional, mat/tile. The border rail may be engaged with the support rib. The border rail may be engaged with an additional, or more than one additional, support rib. The unitary safety surface of mat/tile(s) may include one, or more than one, border rail. The one border rail and the more than one border rail may be structural elements of the unitary safety surface of mat/tile(s).

An anchor may anchor the mat/tile to a location. The anchor may anchor the support rib to a location. The anchor may anchor the border rail to a location. The unitary safety surface of mat/tile(s) may include one, or more than one, anchor. The one anchor and the more than one anchor may be structural elements of the unitary safety surface of mat/tile(s).

A border alert marker may mark a location of a border of the unitary safety surface of mat/tile(s). The location of the border of the unitary safety surface of mat/tile(s) may be marked visually, tactilely and/or via a signal. The signal may be an audio signal. The signal may be an electronic signal. The border alert marker may be associated with the mat/tile. The border alert marker may engage the mat/tile. The border alert marker may be associated with the support rib. The border alert marker may engage the support rib. The border alert marker may be associated with the border rail. The border alert marker may engage the border rail. The unitary safety surface of mat/tile(s) may include one, or more than one, border alert marker. The one border alert marker and the more than one border alert marker may be structural elements of the unitary safety surface of mat/tile(s).

The tile edge of the mat/tile may be configured to engage at least one structural element of the unitary safety surface of mat/tile(s) other than the mat/tile. The tile edge of the mat/tile may be associated with the structural element. At least part of the tile edge of the mat/tile may be complementary in contour to at least part of the structural element.

The tile edge of the mat/tile may adjoin the structural element. The tile edge of the mat/tile may abut the adjoined structural element. The tile edge of the mat/tile may underlie the adjoined structural element. The tile edge of the mat/tile may overlie the adjoined structural element.

The tile edge of the mat/tile may be fastened to the structural element. The tile edge of the mat/tile may be riveted to the structural element. The tile edge of the mat/tile may be screwed to the structural element. The tile edge of the mat/tile may be interlocked with the structural element. The tile edge of the mat/tile may be zipped together with the structural element.

For example, the structural element may be another mat/tile. The tile edge of the mat/tile may be zipped together with the other mat/tile. For example, the tile edge of the mat/tile may feature a peg and/or a hole that may correspond to a complementary hole and/or peg of a tile edge of the other mat/tile. The peg of the tile edge of the mat/tile may be integral to the tile edge of the mat/tile. The peg of the tile edge of the mat/tile may be connected to the tile edge of the mat/tile. The peg of the tile edge of the mat/tile may be tapered away from its connection to the tile edge of the mat/tile; such a taper may allow for ease of alignment with, and insertion into, a hole of a tile edge of the other mat/tile. The peg of the tile edge of the mat/tile may be tapered toward its connection to the tile edge of the mat/tile; such a taper may prevent inadvertent removal of the peg from a hole of a tile edge of the other mat/tile. The peg of the tile edge of the mat/tile may engage a hole of a tile edge of the other mat/tile; the hole of the tile edge of the mat/tile may engage a peg of a tile edge of the other mat/tile. (Such interlocking structural features may be referred to as a "peg & hole" arrangement.)

The unitary safety surface of mat/tile(s) may be manufactured on site. The site may be a playground. Manufacturing the unitary safety surface of mat/tile(s) on site may involve preparing the base layer. Preparing the base layer may include exposing at least part of the ground/flooring surface of the site. Preparing the base layer may include excavating at least part of the site down to a level desired for the ground/flooring surface. Preparing the base layer may include disposing, to a depth, loose fill of the base layer upon the ground/flooring surface. The depth may be about equal to the maximal depth distance of the lowest extremity of the unitary safety surface of mat/tile(s). Alternatively and/or additionally to the maximal depth distance of the extremity, the depth may be about 0", 1", 2" 3" 4" 5" or any other suitable depth. Other suitable depths may include 6", 7", 8", 9" and 10".

Manufacturing the unitary safety surface of mat/tile(s) on site may involve emplacing the mat/tile on the base layer. Loose fill of the base layer may become nestled among and/or beneath the outer pocket shapes of the plurality of pockets of the emplaced mat/tile.

Manufacturing the unitary safety surface of mat/tile(s) on site may involve engaging the emplaced mat/tile with one, or more than one, structural element of the unitary safety surface of mat/tile(s) other than the mat/tile. Engaging the mat/tile with the one, or the more than one, structural element of the unitary safety surface of mat/tile(s) other than the mat/tile may involve engaging the tile edge of the mat/tile with the one, or the more than one, structural element of the unitary safety surface of mat/tile(s) other than the mat/tile.

Manufacturing the unitary safety surface of mat/tile(s) on site may involve overlaying at least part of the interior surface of one of the pockets of the mat/tile with loose fill of the cover layer. All pockets of all mat/tiles of the unitary safety surface of mat/tile(s) may be packed with loose fill.

Manufacturing the unitary safety surface of mat/tile(s) on site may involve overlaying at least part of the pocket upper edge of at least one of the pockets of the mat/tile with loose fill of the overlay layer. All pocket upper edges of all mat/tiles of the unitary safety surface of mat/tile(s) may be overlain with loose fill of the overlay layer. The overlay layer may be about ½", ¾", 1" or a couple inches deep, or of any other suitable depth. Other suitable depths may include 1½" and 2". The loose fill of the overlay layer may be different, in whole or in part, from the loose fill of the base layer. The overlay layer may be optional.

Once the pockets of the mat/tile(s) of the unitary safety surface of mat/tile(s) are packed with loose fill, the mat/tile(s) may exhibit properties akin to a single-piece unitary surface, such as a poured-in-place rubber surface, at least with respect to its accessibility for a wheelchair rider.

At the same time that the mat/tile may provide a wheelchair accessible surface, the loose fill underlying, nestled in and/or overlaying the mat/tile may maintain a high safety factor for the playground. In real-life tests, the mat/tile rates high on ASTM 1951 tests and in tests using the currently-proposed rotational penetrometer manufactured by Beneficial Designs, Inc. of Minden, Nev.

Cost of the unitary safety surface of mat/tile(s) in combination with the base layer, cover layer and overlay layer may be considerably less than that of a conventional unitary surface, providing both safety and accessibility at a reduced cost.

In certain embodiments, the unitary safety surface of mat/tile(s) can be installed in some or all of a playground or other suitable area. The unitary safety surface of mat/tile(s) can be installed along access routes of the playground or other suitable area. The access routes may typically account for half the area of the playground or other suitable area.

Being that the unitary safety surface of mat/tile(s) can be used with sand as loose fill material, the unitary safety surface of mat/tile(s) can be used to make a public beach or other suitable outdoors area accessible, preferably ADA-accessible.

The pockets of the mat/tile can be constructed having a depth of about 2½", any depth from between about 1" and about 6", or any other suitable depth. Other suitable depths may include about 2". Other suitable depths may include about 7". Some embodiments of the pockets may feature the aperture at a downward-facing lowermost extremity of the pocket. The aperture may allow water and/or other liquid to drain out of the interior concavity of the pocket. The aperture may allow water and/or other liquid to drain into the loose fill underlying the mat/tile. While it may be preferable to locate the aperture at the downward-facing extremity, aperture(s) may be placed, alternatively or additionally, anywhere along geometric faces of the pockets' outer shape.

In one embodiment, in which the mat/tile may be square, the size of the mat/tile may range from about 12"×12" to about 48"×48", or may be of any other suitable square size. The mat/tile can be made smaller than 12"×12". The mat/tile can be made larger than 48"×48".

In one embodiment, an about 30" by 30" square mat/tile may be used. In such an embodiment, there may be 8 pockets by 8 pockets for a total of 64 pockets, the pockets having a square upper perimeter and an inverted square pyramidal outer pocket shape. In such an embodiment, a side of the square pocket upper perimeter may be slightly less than 3". In such an embodiment, a width of the pocket upper edge may be slightly less than ½". In other embodiments, a side of the square pocket upper perimeter may be between about 1½" or about 4½", or any other suitable length. In other embodiments, the width of the pocket upper edge may be may be between about ¼" and about 1½", or any other suitable width.

Similar size and/or shape mat/tiles may be engaged in the unitary safety surface of mat/tile(s). Different size and/or shape mat/tiles may be engaged in the unitary safety surface of mat/tile(s). Mat/tiles may be engaged to one another, and/or to other structural elements of the unitary safety surface of mat/tile(s), along mat/tile peripheries, preferably along tile edges.

The mat/tile may be available in a variety of colors. One color option may be black. Black may be the most available color for recycled rubber. Tan can be used to match a color of sand at a beach. Vibrant color(s) may be used to match play equipment. Such color(s) can be formed by adding pigment(s) to the substance(s) of the mat/tile. Alternatively and/or additionally, pigment(s) may be added to the material(s) of the loose fill, particularly of the cover layer and/or the overlay layer.

In one embodiment, the unitary safety surface of mat/tile(s) may be installed on-site using the following method of installation. A selection of the number, size(s) and shape(s) of mat/tiles to be installed may be determined and/or confirmed by assembling mat/tiles, either virtually and/or physically, into a desired configuration upon an area designated for the installation. Other structural elements, such as support ribs and border rails may be similarly configured. The selected structural elements of the configuration may be inspected. Apertures of selected mat/tiles may be inspected; any aperture-blocking mat/tile substance(s) may be selectively removed. The configuration of structural elements may be disassembled. The selected structural elements may be shifted from the designated area to allow for subsequent steps of installation.

Loose fill of the base layer may be spread over at least a part of the area to a suitable depth. The loose fill of the base layer may be spread on an ungraded surface of the area. Alternatively and/or additionally, loose fill surface material may be spread on any playground base or on any other suitable surface. Other suitable surfaces may include the ground/flooring surface.

The area of the surface to be overspread may be at least partly delimited by border rails. Border rails may allow for a play area with a top play surface above the level of surrounding terrain. The area of the surface to be overspread may be set by excavating the area to a depth sufficient to accommodate the base layer, the unitary safety surface of mat/tile(s) and the overlay layer. Alternatively, a pre-existing play area featuring loose fill compatible with the invention may have its loose fill removed over the area to a depth sufficient to accommodate the unitary safety surface of mat/tile(s) and the overlay layer, with the pre-existing loose fill remaining below that depth serving as the base layer.

The mat/tile may be laid upon the ground/flooring surface. The mat/tile may be laid upon the base layer. The mat/tile laid upon the ground/flooring surface and/or upon the base layer may be the unitary safety surface of mat/tile(s).

The mat/tile may be adjoined to additional mat/tiles laid upon the ground/flooring surface and/or upon the base layer. Mat/tiles may be adjoined directly to each other. Mat/tiles may be adjoined indirectly to each other by adjoining mat/tiles to support ribs and/or to border rails.

Before engaging the structural elements laid out in the desired configuration upon the ground/flooring surface and/or upon the base layer, the configuration may be checked. The mat/tiles (and any support ribs) may be leveled. Simply walking upon the mat/tiles (and any support ribs) may level them. Adjoined peripheries, such as tile edges, may be checked and adjusted for complementarity and readied for engagement. Excess mat/tile area may be trimmed at borders of the area, yielding, for example, a trimmed-to-size mat/tile periphery complementary to a border rail. Anchors, such as spikes securing the location of border rails, may be set in place. Anchors, such as weighted bands of rubber connected to, looped below and securing the location of mat/tiles and/or support ribs, may be set in place. Such checking, leveling, readying, trimming, setting and/or other suitable processes may be ongoing and/or repeated as the structural elements are being engaged.

The structural elements laid out in the desired configuration may be engaged to produce the unitary safety surface of mat/tiles.

Adjoined structural elements may be engaged without fasteners. For example, a trimmed-to-size periphery of a mat/tile may closely abut a border rail.

Adjoined structural elements may feature complementarily interlocking peripheries. Complementarily interlocking peripheries may include tile edges featuring peg & hole arrangements.

Adjoined structural elements may be engaged via fasteners. Any suitable fastener may be used to engage adjoined structural elements. Suitable fasteners may include clips and rivets. Rivets may include pop rivets. Suitable fasteners may include screws. For example, the mat/tile may be fastened to a support rib by securely setting a screw through an overlap of the tile edge of the mat/tile and of the support rib. The screws may include stainless steel. The screws may include hard rubber. The screws may include any other suitable substance. Other suitable substances, particularly for an interim playground, may include a biodegradable polymer. Aligned predrilled holes in the support rib and the tile edge may expedite such a fastening process.

Border alert markers may be installed and/or activated at strategic locations along the periphery of the unitary safety surface of mat/tiles. Border alert markers may signal an alert as to a location of the periphery. Border alert markers may be passive indicators of the periphery, such as colored rubber poles or colored flags. Passive indicators may include structural elements with upper surfaces featuring wide deep ridges that may induce vibrations in wheelchair motion. Border alert markers may be active indicators of the periphery, such as generators of focused sonic patterns detectable in approaching the periphery from within the area of the unitary safety surface of mat/tiles. Sonic patterns may be in an audible range. Sonic patterns may be in a subsonic range that may induce tactile vibrations. Border alert markers may be interactive indicators of the periphery, such as detectors sensitive to ambulatory or wheelchair approach, logically coupled with appropriate mechanisms of signal generation.

The cover layer of loose fill may be spread over the unitary safety surface of mat/tiles. The cover layer may be sufficient to fill the pockets of the mat/tiles.

The overlay layer of loose fill may be spread over the cover layer. The overlay layer may rise between about 0" and 3" above the top surface of the unitary safety surface of mat/tiles, or may be of other depths compatible with ADA accessibility standards.

Apparatus and methods in accordance with the invention will now be described in connection with the FIGs. The FIGs. show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

Apparatus and methods described herein are illustrative. Apparatus and methods of the invention may involve some or all of the features of the illustrative apparatus and/or some or all of the steps of the illustrative methods. The steps of the methods may be performed in an order other than the order shown and described herein. Some embodiments may omit steps shown and described in connection with the illustrative methods. Some embodiments may include steps that are not shown and/or not described in connection with the illustrative methods.

Illustrative embodiments will now be described with reference to the accompanying drawings, which form a part hereof.

The apparatus and methods of the invention will be described in connection with embodiments and features of illustrative devices. The devices will be described now with reference to the FIGs. It is to be understood that other embodiments may be utilized and that structural, functional and procedural modifications may be made without departing from the scope and spirit of the present invention.

FIG. 1 shows mat/tile 100. Mat/tile 100 may be square.

Mat/tile 100 may include pockets 102. Pockets 102 may include concave interior surface 103. In the top plan view of FIG. 1, concave inner surface 103 is depicted receding downward toward a bottom of pockets 102. Pockets 102 may be shaped as hollow inverted square pyramids.

Pockets 102 may include apertures 104. Apertures 104 may be located at the bottom of pockets 102. Apertures 104 may be centered within pockets 102.

Mat/tile 100 may include tile edge 106. Tile edge 106 may border pocket rims 107. Pocket rims 107 may be part of square upper perimeters of pockets 102.

Tile edge 106 may include pegs 108.

Mat/tile 100 may include tile edge 110. Tile edge 110 may border pocket rims 107. Tile edge 110 may include holes 112.

Holes 112 may be configured to receive pegs on another structural element, such as a mat/tile or a support rib. Pegs 108 may be configured to be received by holes on another structural element, such as a mat/tile or a support rib. Such peg & hole arrangements (presented in more detail below, in description of FIGS. 5 and 6) may be used to effect engagement of structural elements.

Figure 2:
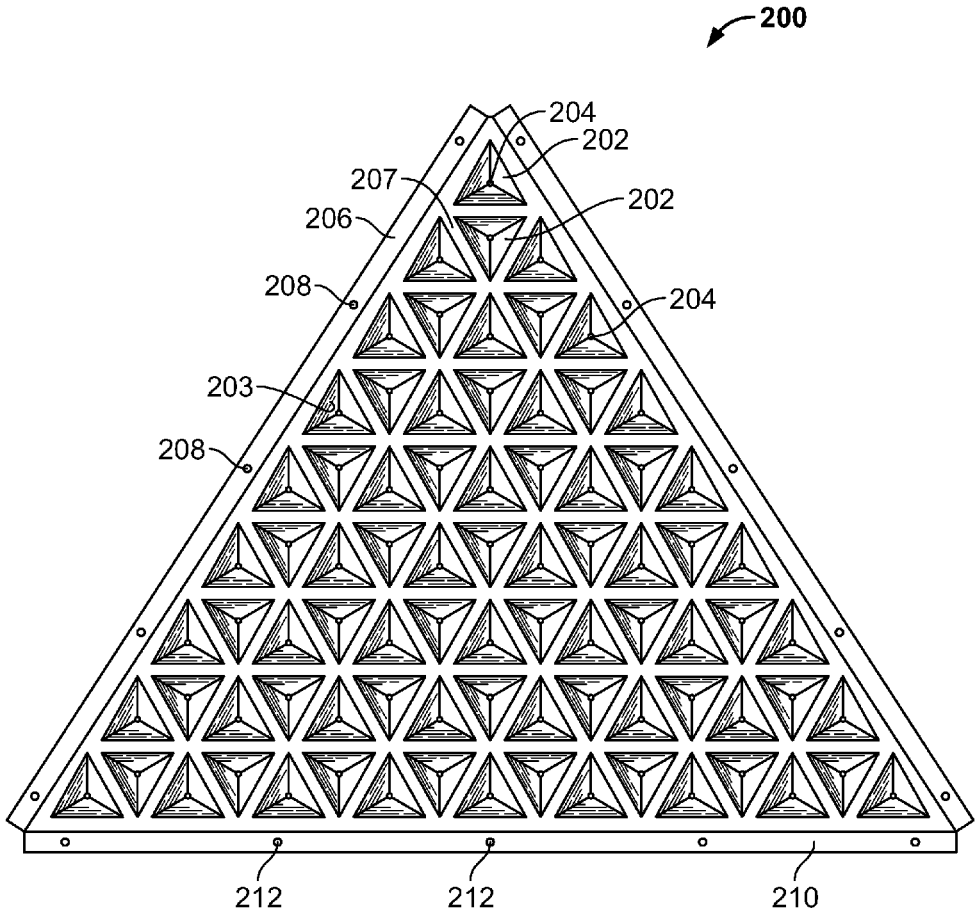
FIG. 2 is another top plan view of apparatus in accordance with principles of the invention.

FIG. 2 shows mat/tile 200. Mat/tile 200 may be triangular.

Mat/tile 200 may include pockets 202. Pockets 202 may include concave interior surface 203. In the top plan view of FIG. 2, concave inner surface 203 is depicted receding downward toward a bottom of pockets 202. Pockets 202 may be shaped as hollow inverted tetrahedra.

Pockets 202 may include apertures 204. Apertures 204 may be located at the bottom of pockets 202. Apertures 204 may be centered within pockets 202.

Mat/tile 200 may include tile edge 206. Tile edge 206 may border pocket rims 207. Pocket rims 207 may be part of triangular upper perimeters of pockets 202.

Tile edge 206 may include pegs 208.

Mat/tile 200 may include tile edge 210. Tile edge 210 may border pocket rims 207. Tile edge 210 may include holes 212.

Holes 212 may be configured to receive pegs on another structural element. Pegs 208 may be configured to be received by holes on another structural element.

Figure 3:
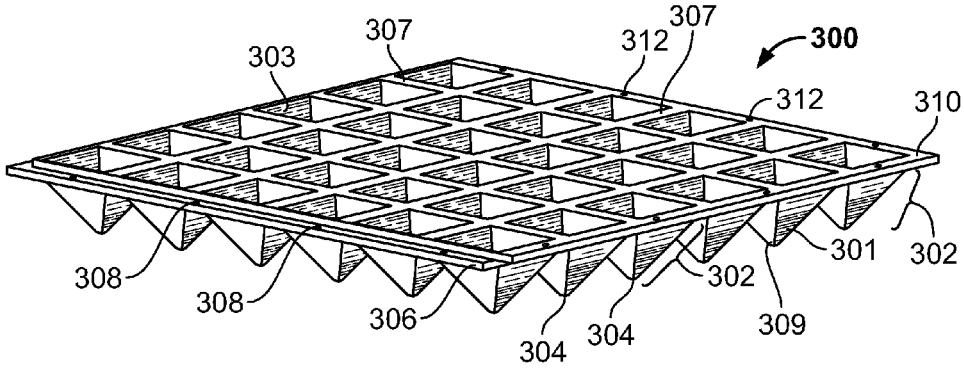
FIG. 3 is a perspective view of apparatus in accordance with principles of the invention.

FIG. 3 shows mat/tile 300. Mat/tile 300 may be similar to mat/tile 100 (shown in FIG. 1).

Mat/tile 300 may include convex exterior surface 301. Convex exterior surface 301 may be part of pockets 302.

Pockets 302 may include concave interior surface 303. Pockets 302 may be shaped as hollow inverted square pyramids. Convex exterior surface 301 may be part of a geometric face of the inverted square pyramids of pockets 302. Lowermost extremities 309 may be downward facing apices of the inverted square pyramids.

Pockets 302 may include apertures 304. Apertures 304 may interrupt convex exterior surface 301. Apertures 304 may truncate the inverted square pyramids. The inverted square pyramids, as depicted, may feature blunted apices. Blunted apices may indicate the presence of apertures 304.

Mat/tile 300 may include tile edge 306. Tile edge 306 may border pocket rims 307. Pocket rims 307 may be part of square upper perimeters of pockets 302.

Tile edge 306 may include pegs 308.

Mat/tile 300 may include tile edge 310. Tile edge 310 may border pocket rims 307. Tile edge 310 may include holes 312.

Figure 4:
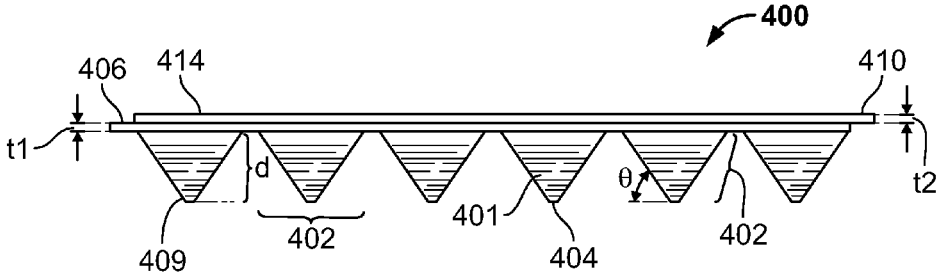
FIG. 4 is a side view of apparatus in accordance with principles of the invention.

FIG. 4 shows mat/tile 400. Mat/tile 400 may be similar to mat/tile 100 (shown in FIG. 1). Mat/tile 400 may be similar to mat/tile 200 (shown in FIG. 2). Mat/tile 400 may be similar to mat/tile 300 (shown in FIG. 3).

Mat/tile 400 may include pockets 402. Pockets 402 may include exterior surface 401. Pockets 402 may include aperture 404. Aperture 404 may interrupt exterior surface 401. An interruption of exterior side 401 by aperture 404 may be proximal to downward-facing extremity 409. Aperture 404 may pass through downward-facing extremity 409.

Pockets 402 may feature depth d. Depth d may represent a depth of pockets 402. Depth d may be any suitable depth.

Pockets 402 may feature angle θ. Angle θ may represent an angle of an exterior side of pockets 402 with respect to a horizontal plane of mat/tile 400. Angle θ may be any suitable angle that promotes engagement of mat/tile 400 with loose fill of the base layer under mat/tile 400.

Mat/tile 400 may include tile edge 406. Tile edge 406 may include thickness t1. Thickness t1 may represent the thickness of tile edge 406. Thickness t1 may be any suitable thickness.

Mat/tile 400 may include tile edge 410. Tile edge 410 may include thickness t2. Thickness t2 may represent the thickness of tile edge 410. Thickness t2 may be any suitable thickness.

Line 414 may represent a topmost level of mat/tile 400. Overall height of mat/tile 400 may be given by a distance along a perpendicular (not shown) from line 414 to downward-facing extremity 409. Overall height of mat/tile 400 may be given by a sum of thickness t1 plus thickness t2 plus depth d.

Figure 5:
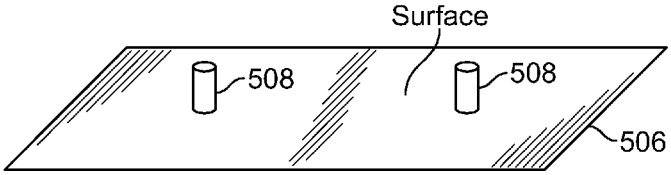
FIG. 5 is an enlarged view of one or more features of apparatus in accordance with principles of the invention.

FIG. 5 shows a portion of tile edge 506. Tile edge 506 may include pegs 508. Pegs 508 may be similar to pegs 108 (shown in FIG. 1). Pegs 508 may be similar to pegs 208 (shown in FIG. 2). Pegs 508 may be similar to pegs 308 (shown in FIG. 3). Pegs 508 may be similar to pegs of peg & hole arrangements in other structural elements (not shown).

Peg 508 may be connected to a surface of tile edge 506 at a proximal end of peg 508. In certain embodiments, tile edge 506 may include pegs 508 that enlarge (not shown) toward distal ends of pegs 508.

Figure 6:
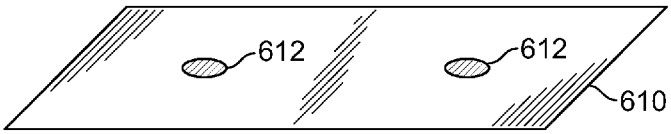
FIG. 6 is another enlarged view of one or more features of apparatus in accordance with principles of the invention.

FIG. 6 shows a portion of tile edge 610. Tile edge 610 may include holes 612. Holes 612 may be similar to holes 112 (shown in FIG. 1). Holes 612 may be similar to holes 212 (shown in FIG. 2). Holes 612 may be similar to holes 312 (shown in FIG. 3). Holes 612 may be similar to holes of peg & hole arrangements in other structural elements (not shown).

In embodiments with tile edge 506 (shown in FIG. 5) including pegs 508 that enlarge (not shown) toward distal ends of pegs 508, pegs 508 may lock into holes 612 such that a special tool may be required to engage tile edge 506 to tile edge 610. In such embodiments, a special tool may be required to disengage the engaged tile edges.

Figure 7A:
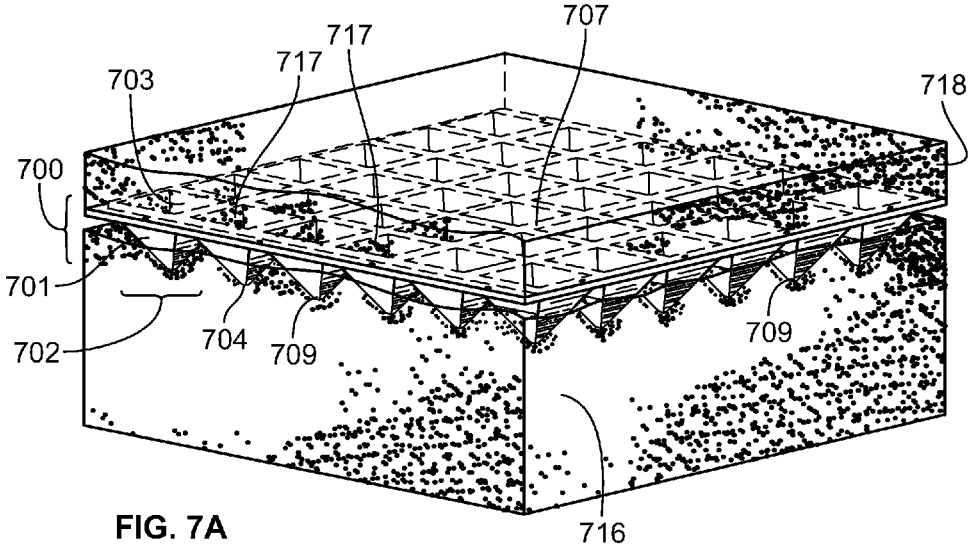
FIGS. 7A and 7B are perspective views of apparatus in accordance with principles of the invention, shown in-situ.
Figure 7B:
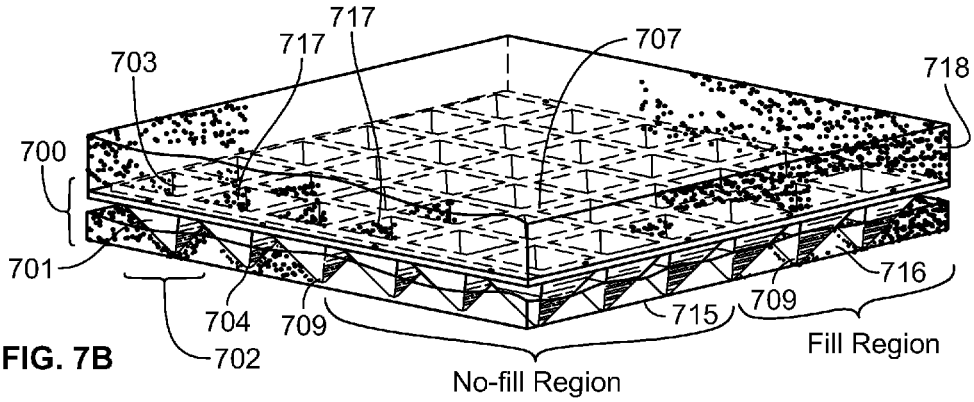

FIGS. 7A and 7B show mat/tile 700. FIGS. 7A and 7B also show loose fill. Portions of loose fill may be represented in the perspective views of FIGS. 7A and 7B by dots and/or clumps depicted beneath, within and/or above mat/tile 700.

Mat/tile 700 may include exterior surface 701. Exterior surface 701 may be an exterior surface of pocket 702. Pocket 702 may include interior concave surface 703. Pocket 702 may include aperture 704. Pocket 702 may include pocket rim 707. A topmost level of mat/tile 700 may include a topmost surface of pocket rim 707.

Base layer 716 may include loose fill. Pocket 702 may engage base layer 716. Exterior surface 701 may engage base layer 716.

Cover layer 717 may include loose fill. Loose fill of cover layer 717 may be nestled within, and/or stabilized by, pocket 702. Loose fill of cover layer 717 may cover interior surface 703. Loose fill of cover layer 717 may fill pocket 702 up to pocket rim 707. Loose fill of cover layer 717 may cover mat/tile 700 up to the topmost level of mat/tile 700.

Mat/tile 700, in conjunction with cover layer 717, may provide both wheelchair accessibility and safety from falls.

Overlay layer 718 may include loose fill. Loose fill of overlay layer 718 may rise above the topmost level of mat/tile 700. A depth of overlay layer 718 above the topmost level of mat/tile 700 may provide enhanced safety from falls.

FIG. 7A shows base layer 716 underlying extremities 709. Base layer 716 may include a depth of loose fill below extremities 709. Aperture 704 may allow drainage of fluid from interior surface 703 to base layer 716. Loose fill of base layer 716 may be nestled against, and/or stabilized by, exterior surface 701.

FIG. 7B shows ground/flooring surface 715. Extremities 709 may contact ground/flooring surface 715. Aperture 704 may allow drainage of fluid from interior surface 703 to ground/flooring surface 715. A No-fill Region below mat/tile 700 may be free of loose fill. The No-fill Region may underlie none, some or all of mat/tile 700. A Fill Region below mat/tile 700 may include loose fill. The Fill Region may underlie none, some or all of mat/tile 700. In the Fill Region, loose fill may be nestled against, and/or stabilized by, exterior surface 701.

Figure 8:
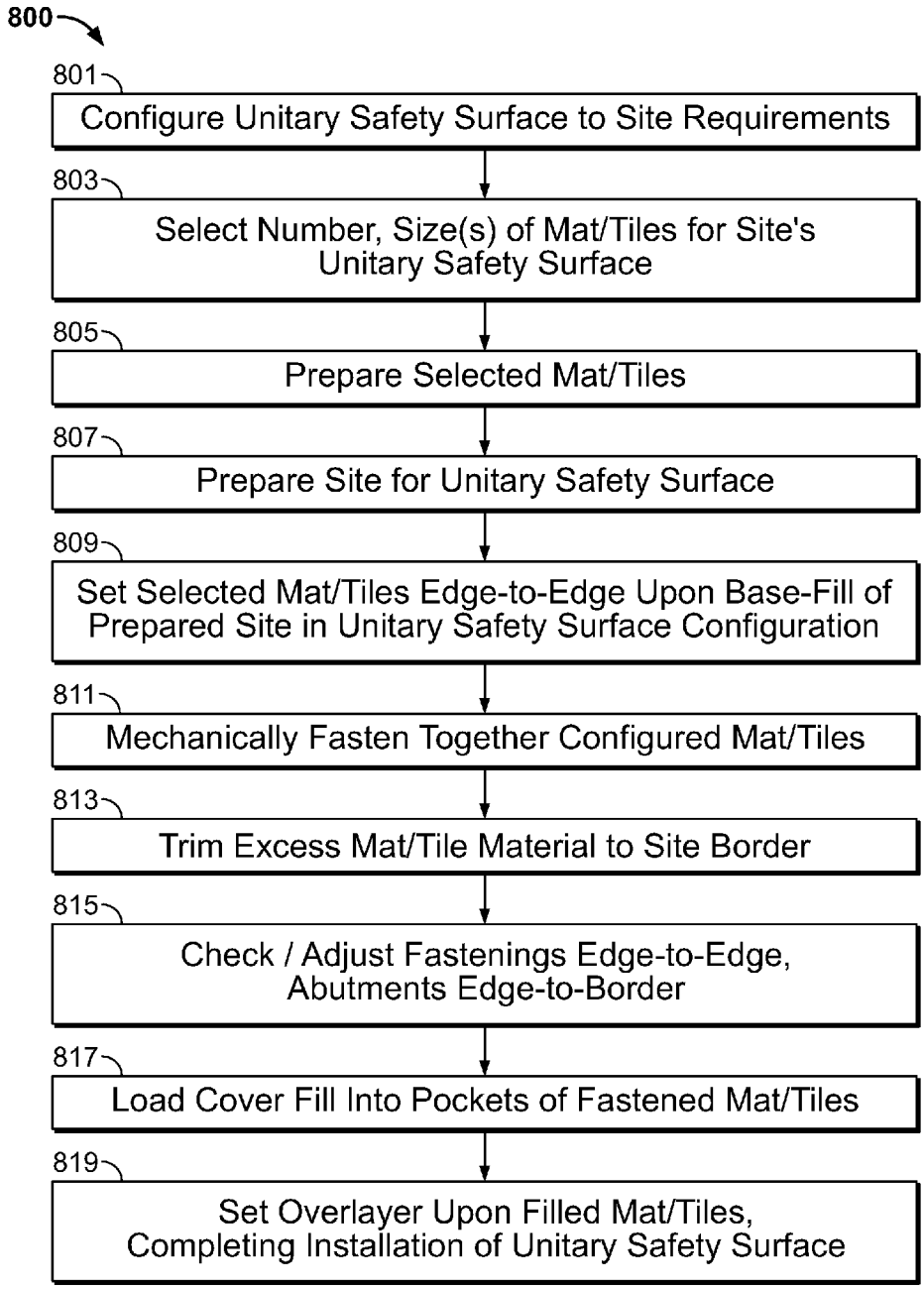
FIG. 8 is a flow diagram of an illustrative process in accordance with the principles of the invention.

Processes in accordance with the principles of the invention may include one or more features of the processes illustrated in FIG. 8. One or more steps of the processes may be performed with all or portions of the apparatus shown in FIGS. 1, 2, 3, 4, 5, 6, 7A and 7B.

Some steps of the process may be performed by one person, while other steps may be performed by more than one person. For simplicity of presentation, the steps of the process are presented performed by an "installer." For simplicity of presentation, a site the installer is working on is presented as a "playground."

FIG. 8 shows illustrative steps of process 800 for on-site installation of a unitary safety surface of mat/tiles. The process may begin at step 801.

At step 801, the installer may configure a planned unitary safety surface of mat/tiles to requirements of the playground. Requirements of the playground may include specifics as to an area, a shape of the area and locations along a periphery of the area that the unitary safety surface of mat/tiles is to underlie. Specifics as to the area, the shape of the area and/or locations along the periphery of the area may typically include information about routes of access to the playground. Requirements of the playground may include specifics as to locations and types of existing and/or planned playground equipment. Requirements of the playground may include any other suitable specifics. Other suitable specifics may include surface and subsurface considerations, such as colors of equipment and/or of surrounding terrain, and such as locations of underground utilities. Other suitable specifics may include playground traffic projections, including user-age demographics. Other suitable specifics may include a projected lifetime of the playground. Other suitable specifics may include budgetary considerations.

Configuring the planned unitary safety surface of mat/tiles may be carried out by assessment of the requirements. Assessments may be done remotely and/or on site. Assessments may include determination of base layer loose fill material, base layer height, overlay layer loose fill material and overlay layer height.

Configuring may be carried out virtually on paper, via computer and/or by other suitable means. Configuring may be carried out physically, as in laying out upon the area all or some of proposed components of the planned unitary safety surface of mat/tiles.

Configuring the planned unitary safety surface of mat/tiles may be an iterative process. Successful configuring the planned unitary safety surface of mat/tiles may be followed by step 803.

At step 803, the installer may select the number, size(s) and shape(s) of mat/tiles to be used in the planned unitary safety surface of mat/tiles. Size(s) may include mat/tile "footprint" size(s), mat/tile height(s) and pocket upper perimeter(s). Shape(s) may include mat/tile "footprint" shape(s), pocket outer shape(s) and pocket perimeter shape(s).

The installer may, similarly, select number, size(s) and shape(s) of other structural elements. The installer may also select other features of components of the planned unitary safety surface of mat/tiles, such as tile edge type (e.g., peg & hole arrangement), fasteners, color(s) and variety of border alert markers.

At step 805, the installer may prepare the selected structural elements, such as mat/tiles. Preparation may involve inspection of the selected structural elements. Inspection may include checking for blockages of pocket apertures or of tile edge holes. Preparation may involve removal of blockages of pocket apertures or of tile edge holes. Preparation may involve shifting the selected structural elements off of the area.

At step 807, the installer may prepare the site for installation of the planned unitary safety surface of mat/tiles. The installer may set border rails along the periphery of the playground or a portion of the periphery of the playground.

The installer may excavate the area to several inches below a desired depth of the unitary safety surface of mat/tiles. The installer may fill the area, to a height corresponding to those several inches, with base layer loose fill. (For a playground with a pre-existing loose fill compatible with the invention, the installer may, instead, remove the pre-existing loose fill to a depth desired for the unitary safety surface of mat/tiles, the remaining pre-existing loose fill serving as the base layer.) The installer may level the base layer.

At step 809, the installer may set the selected structural elements, such as the selected mat/tiles, upon the base layer, engaging loose fill of the base layer beneath the mat/tiles. The structural elements may be set adjoining each other in the configuration of the planned unitary safety surface of mat/tiles. Adjoining mat/tiles may be set tile edge to tile edge. Tile edges of peg & hole arrangements may be set overlapping.

The structural elements may be modified to accommodate existing or planned playground equipment (e.g., a circular section may be cut out of a corner of a mat/tile to accommodate a support pole of a swing set). The structural elements may be leveled. The installer may adjust structural elements relative to each other upon the base layer to achieve a final configuration ready for structural engagement.

At step 811, the installer may engage the structural elements, such as mat/tiles, configured together upon the base layer. The installer may mechanically fasten together the structural elements. Mat/tiles may be mechanically engaged to each other. Mat/tiles may be mechanically engaged to support ribs. Mat/tiles may be mechanically engaged to border rails. Support ribs may be mechanically engaged to each other. Support ribs may be mechanically engaged to border rails. Anchors may be set in place. Setting anchors in place may stabilize structural elements of the unitary safety surface of mat/tile(s).

At step 813, the installer may adjust mat/tiles to optimally adjoin a border of the site (a "site border"). The installer may trim away excess mat/tile "footprint" to produce an adjusted tile edge. The adjusted tile edge may optimally adjoin the site border.

The site border may be part of an access route to the playground. At such site borders, the installer may particular focus on several factors to produce smooth transition to the access route. The factors may include height of mate/tiles adjoining the site border; closeness of complementarity and engagement of mate/tiles to the site border; and mechanical security of engagement of mat/tiles to the site border.

At step 815, the installer may perform a final set of inspections (and, if need be, iterative adjustments and checks) of mechanical engagements of structural elements of the unitary safety surface of mat/tiles. Mechanical engagements to be inspected may include fastenings of tile edges to tile edges and abutments of tile edges to border rails. Other mechanical engagements to be inspected may include interlocking of tile edges with support ribs, settings of anchors in their positions, and engagement of mat/tiles to access route site borders.

At step 817, the installer may load cover layer loose fill into pockets of the mat/tiles fastened into the unitary safety surface of mat/tile(s). The installer may fill the pockets with cover layer.

At step 819, the installer may set the overlay layer of loose fill upon the filled pockets of the unitary safety surface of mat/tiles. The installer may level the upper surface of the overlay layer. The installer may thus complete the installation.

FIGS. 9A, 9B, 10, 11, 12, 13, 14A, 14B, 15, 16, 17 and 18 each shows one or more steps of processes of installation of a unitary safety surface of mat/tiles. One or more steps of the processes may be performed with all or portions of the apparatus shown in FIGS. 1-7, and may involve one or more steps of the processes shown in FIG. 8.

Figure 9A:
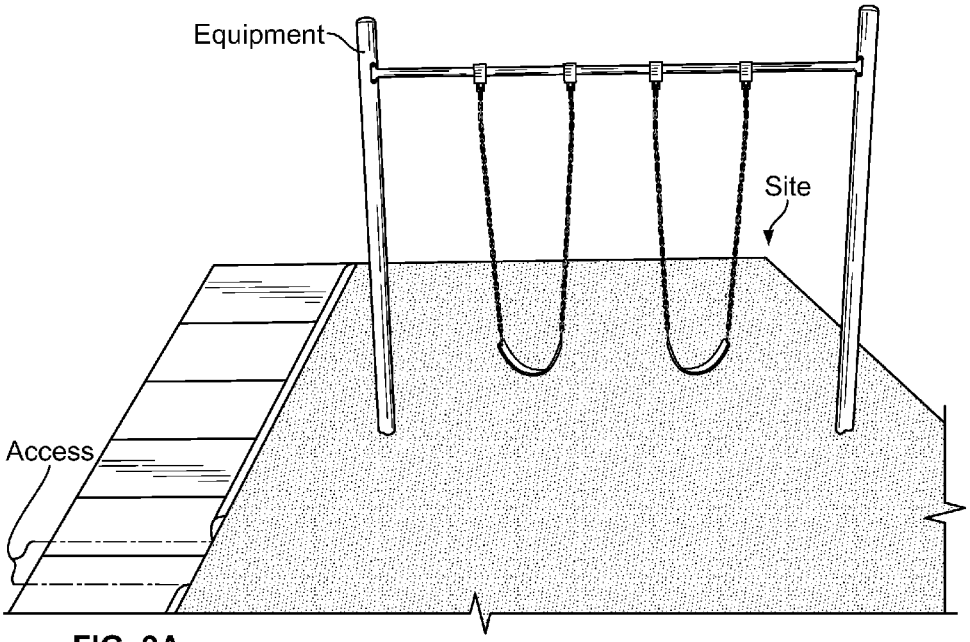
FIGS. 9A and 9B are perspective views of a site (FIG. 9A) before and (FIG. 9B) after a preliminary step of an illustrative process in accordance with the principles of the invention.

FIG. 9A shows a site, such as a playground. The site may be assessed as to its requirements for a planned unitary safety surface of mat/tiles (as presented in description of step 801, shown in FIG. 8). Such requirements may include the site's area, the presence of equipment and the location of access from outside the site.

Figure 9B:
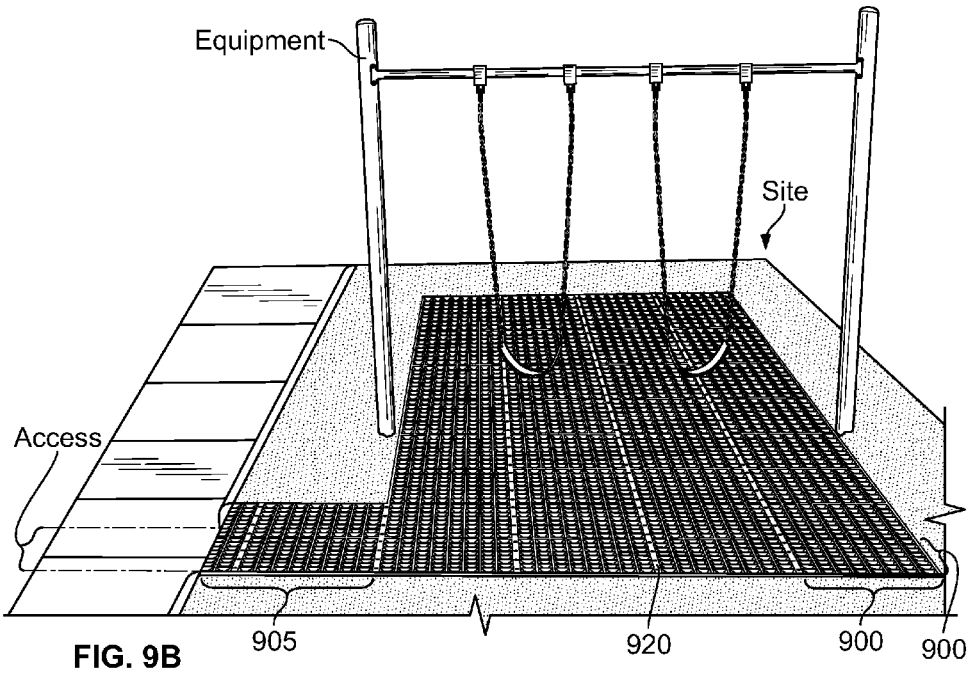

FIG. 9B shows a selection of structural elements, such as mat/tile 900, laid out upon the site (as presented in description of step 803, shown in FIG. 8) approximating a configuration of the planned unitary safety surface of mat/tiles. Mat/tile 900 may have a rectangular "footprint." Other structural elements may include support rib 920. The configuration may accommodate the equipment. The configuration may include access route 905 leading from the location of access from outside the site.

Figure 10:
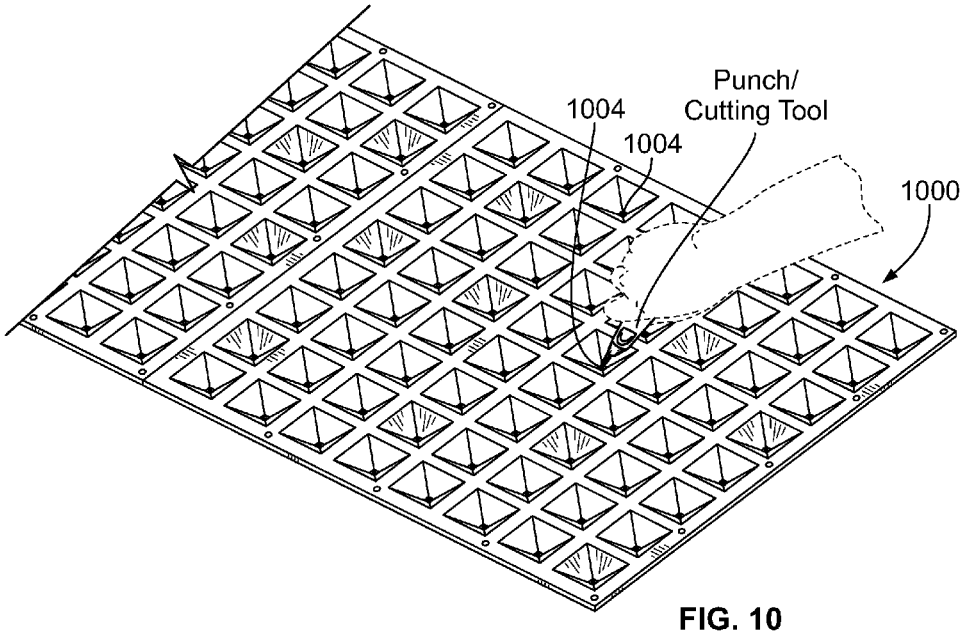
FIG. 10 shows one or more steps of an illustrative process in accordance with the principles of the invention.

FIG. 10 shows mat/tile 1000 being prepared (as presented in description of step 805, shown in FIG. 8). Aperture 1004 may be cleared of blockage. A punch/cutting tool may be used to clear aperture 1004 of blockage.

Figure 11:
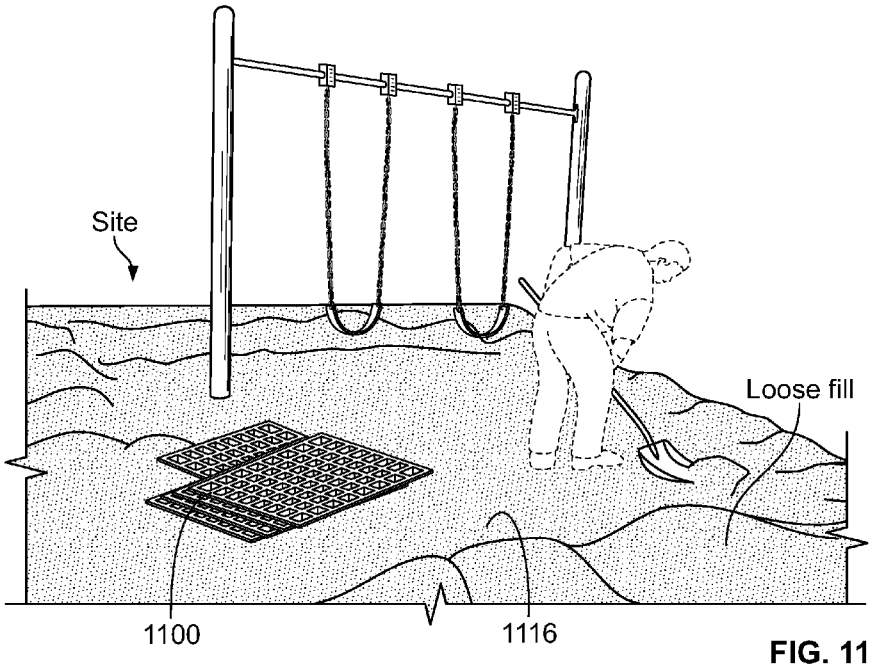
FIG. 11 shows one or more steps of an illustrative process in accordance with the principles of the invention.

FIG. 11 shows the site being prepared (as presented in description of step 807, shown in FIG. 8), with prepared mat/tile 1100 off to a side. Pre-existing loose fill may be dug out to a level desired for base layer 1116. Pre-existing loose fill dug from the site may be piled up proximal to the area.

Figure 12:
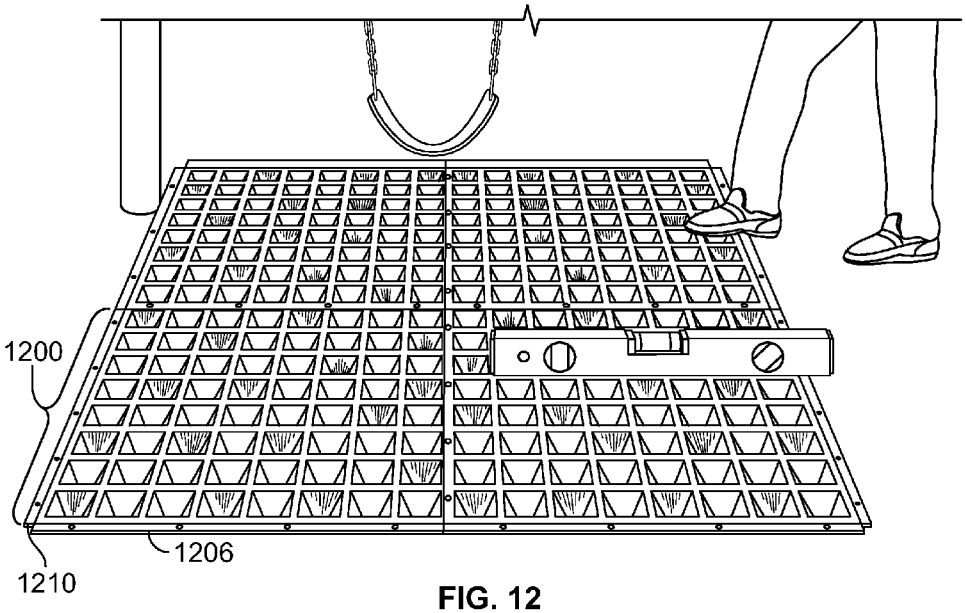
FIG. 12 shows one or more steps of an illustrative process in accordance with the principles of the invention.

FIG. 12 shows mat/tile 1200 set adjoining other mat/tiles (as presented in description of step 809, shown in FIG. 8). Mat/tile 1200 may include tile edge 1206. Mat/tile 1200 may include tile edge 1210. Mat/tile 1200 and the other mat/tiles are shown being leveled. Leveling of mat/tiles may be accomplished by walking upon them.

Figure 13:
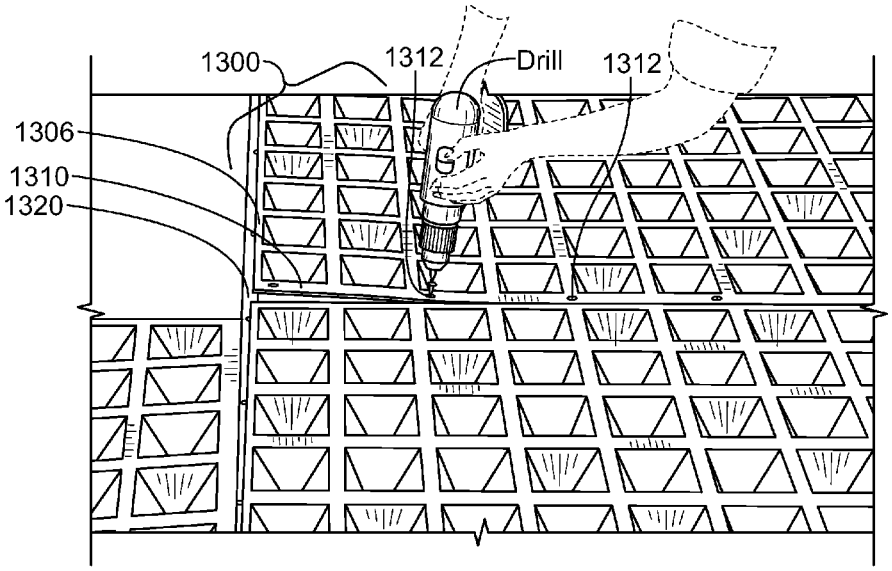
FIG. 13 shows one or more steps of an illustrative process in accordance with the principles of the invention.

FIG. 13 shows mat/tile 1300 being fastened to another mat/tile (as presented in description of step 811, shown in FIG. 8). Mat/tile 1300 may include tile edge 1310.

Tile edge 1310 may include holes 1312. Mat/tile 1300 may be fastened to other mat/tiles by inserting a fastener through hole 1312 and into a tile edge of another mat/tile. The fastener may be secured. A drill may be used to secure the fastener.

Mat/tile 1300 may include tile edge 1306. Tile edge 1306 is shown above support rib 1320. Support rib 1320 may extend along a length of edge 1306 below mat/tile 1300. Tile edge 1306 may be below (not shown) support rib 1320. Support rib 1320 may extend along a length of edge 1306 above (not shown) mat/tile 1300. Tile edge 1306 may be fastened (not shown) to support rib 1320.

Figure 14A:
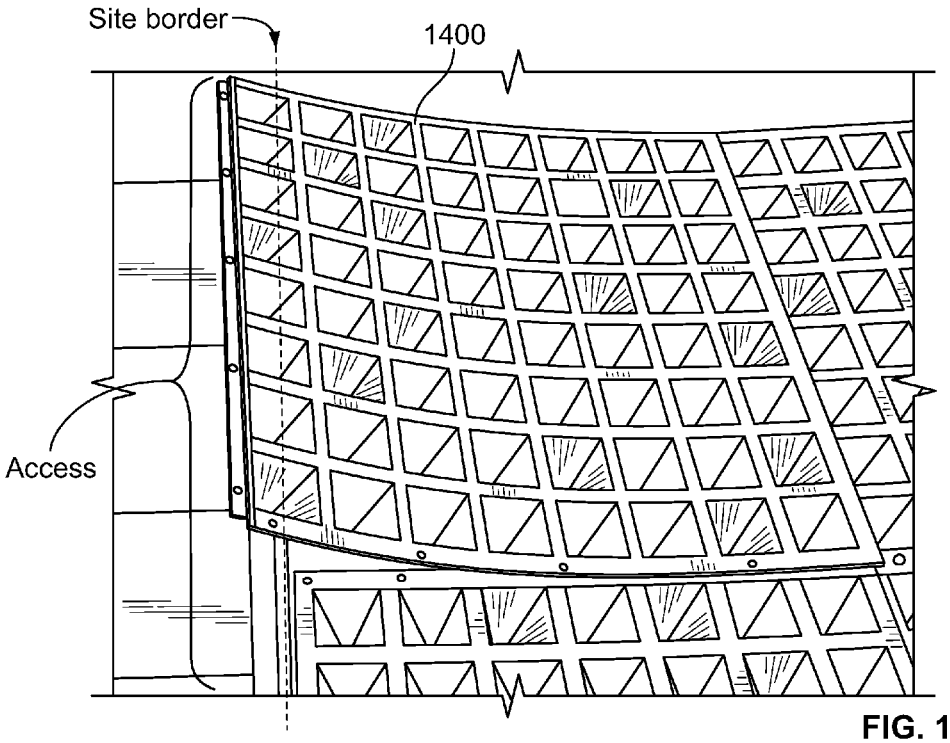
FIGS. 14A and 14B show one or more steps of an illustrative process in accordance with the principles of the invention.

FIG. 14A shows an excess of mat/tile 1400 overhanging a site border (indicated by dashed line) along an access to the playground.

Figure 14B:
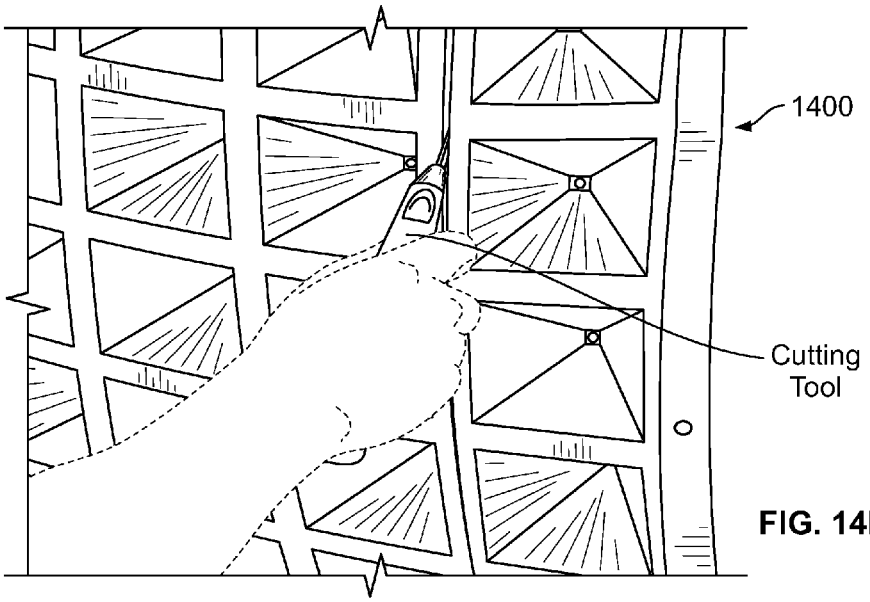

FIG. 14B shows the excess of mat/tile 1400 being trimmed away (as presented in description of step 813, shown in FIG. 8). A cutting tool may be used to trim away the excess of mat/tile 1400. Trimming away the excess of mat/tile 1400 may produce an optimal fit (not shown) of mat/tile 1400 with the site border.

Figure 15:
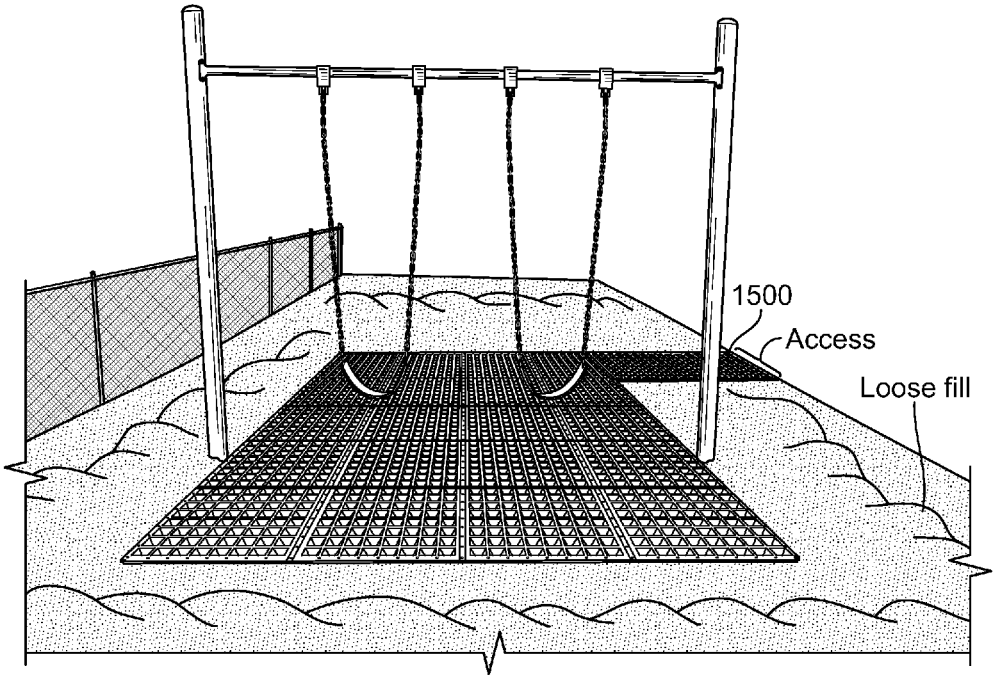
FIG. 15 shows one or more steps of an illustrative process in accordance with the principles of the invention.

FIG. 15 shows mat/tile 1500. Mat/tile 1500 may be optimally fit to accommodate access to the playground. Mat/tile 1500 is shown fastened together with other structural elements to form a unitary safety surface of mat/tiles. The unitary safety surface of mat/tiles may be inspected and adjusted (as presented in description of step 815, shown in FIG. 8).

Figure 16:
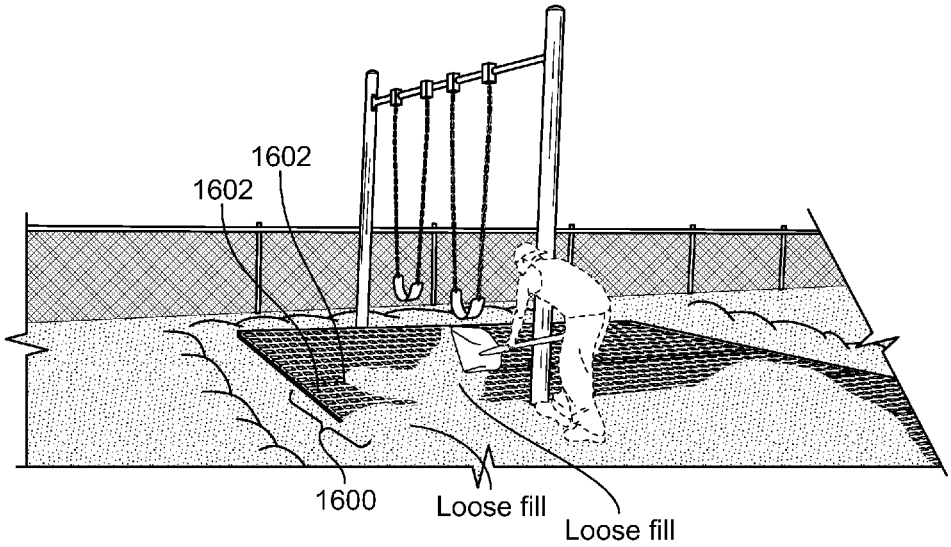
FIG. 16 shows one or more steps of an illustrative process in accordance with the principles of the invention.

FIG. 16 shows mat/tile 1600 being covered with loose fill. Mat/tile 1600 may include pockets 1602. Pockets 1602 may be at least partly covered with loose fill. Pockets 1602 may be filled with loose fill (as presented in description of step 817, shown in FIG. 8).

Figure 17:
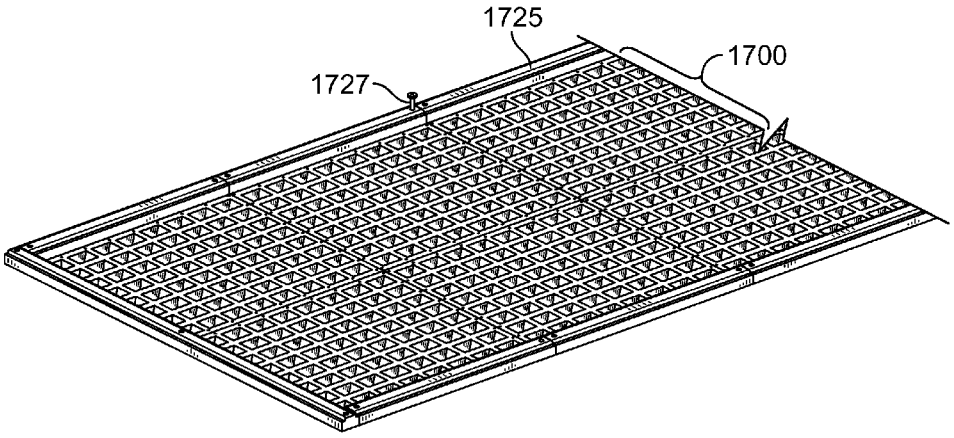
FIG. 17 is a perspective view of apparatus in accordance with principles of the invention.

FIG. 17 shows mat/tile 1700. Mat/tile 1700 may adjoin border rail 1725. Border rail 1725 may provide definition to a periphery of a unitary safety surface of mat/tiles that includes mat/tile 1700. Border rail 1725 may be set in place via anchor 1727 being securely set into terrain bordering the periphery of the unitary safety surface of mat/tiles.

Figure 18:
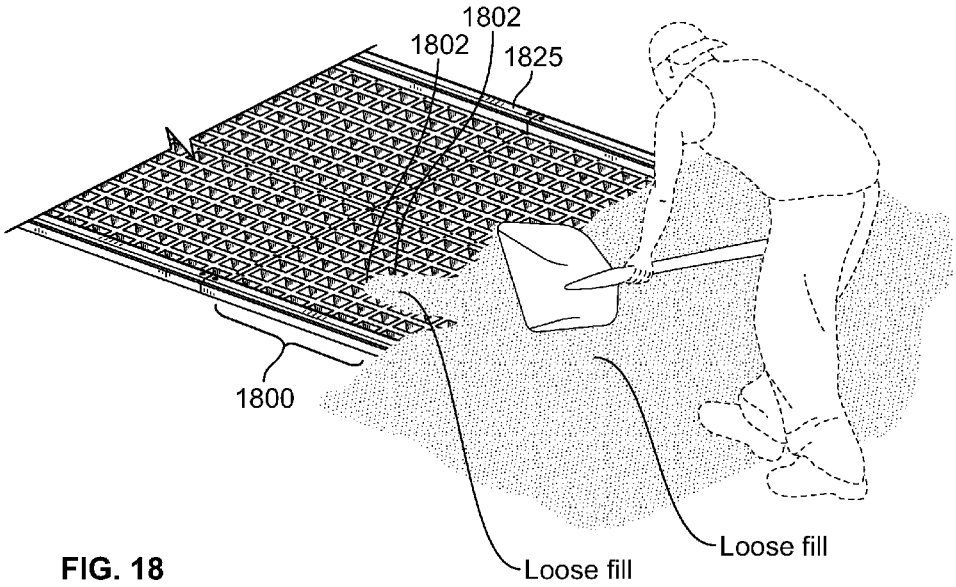
FIG. 18 show one or more steps of an illustrative process in accordance with the principles of the invention, involving the apparatus shown in FIG. 17.

FIG. 18 shows mat/tile 1800 being covered with loose fill. Mat/tile 1800 may include pockets 1802. Pockets 1802 may be at least partly covered with loose fill. Pockets 1802 may be filled with loose fill (as presented in description of step 817, shown in FIG. 8). Border rail 1825 may provide definition and/or support to the periphery of a unitary safety surface of mat/tiles that includes mat/tile 1800. Border rail 1825 may allow a level of mat/tile 1800 and/or a level of loose fill above mat/tile 1800 to be raised above the terrain surrounding the unitary safety surface of mat/tiles.

Thus, apparatus and methods for unitary safety surface tiles and associated structures have been provided. Persons skilled in the art will appreciate that the present invention can be practiced by other than the described embodiments, which are presented for purposes of illustration rather than of limitation. The present invention is limited only by the claims that follow.

What is claimed is:

1. A unitary safety surface tile of a unitary safety surface and an environment of the tile, said environment and tile comprising:

a base of loose fill, the tile disposed on the base;

a cover of loose fill overlaying the tile;

a plurality of empty tile pockets, each of the pockets having at least one pocket upper edge, an outer surface of each of the pockets for engaging at least a part of the base of loose fill and an inner surface of each of the pockets for receiving at least a part of the cover of loose fill, each of the pockets further comprising at least one aperture for allowing passage of fluid through each of the pockets; and a plurality of tile edges, said plurality of tile edges bordering the plurality of empty pockets, at least one of the plurality of tile edges for engaging a structural element of the unitary safety surface.

2. The unitary safety surface tile and environment of claim 1, wherein the tile comprises a material selected from the group consisting of plastic, rubber and wood fiber.

3. The unitary safety surface tile and environment of claim 1, wherein the at least one pocket upper edge comprises at least a part of a pocket upper perimeter.

4. The unitary safety surface tile and environment of claim 3, wherein at least part of the outer surface comprises at least part of a pocket outer shape.

5. The unitary safety surface tile and environment of claim 4, wherein the pocket outer shape comprises a ledge.

6. The unitary safety surface tile and environment of claim 4, wherein the pocket outer shape comprises at least one extremity at a maximal depth distance from the pocket upper edge.

7. The unitary safety surface tile and environment of claim 6, wherein a perimeter of the pocket outer shape proximal to the extremity and parallel to the pocket upper perimeter is smaller than the pocket upper perimeter.

8. The unitary safety surface tile and environment of claim 1, wherein each of the pockets is proximal, along the at least one pocket upper edge, to at least one other of the pockets.

9. A unitary safety surface tile and an environment of the tile, said tile for association with at least one other unitary safety surface tile, said environment and tile comprising:

a base of loose fill, the tile disposed on the base;

a cover of loose fill overlaying the tile;

a plurality of empty tile pockets, each of the pockets having at least one pocket upper edge, each of the pockets being proximal, along the at least one pocket upper edge, to at least one other of the pockets, an outer surface of each of the pockets for engaging at least a part of the base of loose fill and an inner surface of each of the pockets for receiving at least a part of the cover of loose fill, each of the pockets further comprising at least one aperture for allowing passage of fluid between the inner surface and the outer surface; and a plurality of tile edges, said plurality of tile edges bordering the plurality of empty pockets, at least one of the plurality of tile edges for engaging at least one other unitary safety surface tile.

10. A unitary safety surface for wheelchair accessibility, said surface having at least two unitary safety surface tiles, each tile having an environment, the environment and each tile comprising:

a base of loose fill, the tile disposed on the base;

a cover of loose fill overlaying the tile;

a plurality of empty tile pockets, each of the pockets having an exterior surface, an interior surface and a rim, the exterior surface for engaging at least a part of the base of loose fill and the interior surface for receiving at least a part of the cover of loose fill, each of the pockets further comprising at least one aperture for allowing passage of fluid from the interior surface to the exterior surface; and a plurality of edges, said plurality of edges bordering the rims, at least one of the plurality of edges for engaging a structural element of the unitary safety surface.

11. The unitary safety surface of claim 10, wherein each of the pockets is proximal, along the rim, to at least one other of the pockets.

12. The unitary safety surface of claim 10, wherein the structural element comprises a unitary safety surface structural element selected from the group consisting of tiles, anchors, support ribs, border rails and border alert markers.

13. A method for manufacturing, on site, a unitary safety surface for wheelchair accessibility, the unitary safety surface including at least two unitary safety surface tiles, the method comprising:

placing loose fill material as a base layer into a defined area in which the unitary safety surface is to be formed, emplacing, upon the base layer, one of the at least two unitary safety surface tiles, each of the tiles having:

a plurality of empty pockets, each of the pockets having an exterior surface, an interior surface, an aperture and a rim, the exterior surface for engaging at least a part of the base layer, and the aperture for allowing passage of fluid from the interior surface to the base layer, and a plurality of edges, said plurality of edges bordering the rims;

engaging at least one of the plurality of edges of the emplaced tile with a structural element of the unitary safety surface; and overlaying at least part of the interior surface of at least one of the pockets with loose fill.

14. The method of claim 13, wherein each of the pockets is proximal, along the rim, to at least one other of the pockets.

15. The method of claim 13, wherein the structural element comprises another unitary safety surface tile.

16. The method of claim 13, wherein the structural element comprises a support rib.

17. The method of claim 13, wherein the structural element comprises a border rail.

18. The method of claim 13, wherein the structural element comprises an anchor.

19. The method of claim 13, wherein the structural element comprises a border alert marker.

20. The method of claim 13, wherein the unitary safety surface further comprises a border alert marker.

21. The method of claim 20, wherein the border alert marker engages at least one of the plurality of tile edges.

22. The method of claim 20, wherein the border alert marker engages a border rail of the unitary safety surface.

23. The method of claim 13, further comprising overlaying at least part of the upper edge of at least one of the pockets with loose fill.

* * * * *